US012286922B2

(12) United States Patent
Dietz

(10) Patent No.: US 12,286,922 B2
(45) Date of Patent: Apr. 29, 2025

(54) THERMAL INSULATION STRUCTURE AND METHOD OF MAKING SAME

(71) Applicant: 3M INNOVATIVE PROPERTIES COMPANY, St. Paul, MN (US)

(72) Inventor: Peter T. Dietz, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 235 days.

(21) Appl. No.: 17/783,134

(22) PCT Filed: Dec. 11, 2020

(86) PCT No.: PCT/IB2020/061843
§ 371 (c)(1),
(2) Date: Jun. 7, 2022

(87) PCT Pub. No.: WO2021/124057
PCT Pub. Date: Jun. 24, 2021

(65) Prior Publication Data

US 2023/0021664 A1 Jan. 26, 2023

Related U.S. Application Data

(60) Provisional application No. 62/949,173, filed on Dec. 17, 2019.

(51) Int. Cl.
*F01N 3/28* (2006.01)

(52) U.S. Cl.
CPC ..... *F01N 3/2871* (2013.01); *F01N 3/2864* (2013.01)

(58) Field of Classification Search
CPC ..... F01N 3/2853; F01N 3/2864; F01N 3/2871
See application file for complete search history.

(56) References Cited

U.S. PATENT DOCUMENTS

| | | | |
|---|---|---|---|
| 4,999,168 | A | 3/1991 | Ten Eyck |
| 6,051,193 | A | 4/2000 | Langer et al. |
| 6,077,483 | A | 6/2000 | Locker et al. |
| 8,277,925 | B2 | 10/2012 | Dietz |
| 11,015,506 | B2 | 5/2021 | Sako |

(Continued)

FOREIGN PATENT DOCUMENTS

| | | | |
|---|---|---|---|
| EP | 1495807 | A1 | 1/2005 |
| EP | 2363582 | A1 | 9/2011 |

(Continued)

OTHER PUBLICATIONS

International Search Report for PCT Application No. PCT/IB2020/061843 mailed on Jan. 29, 2021, 5 pages.

*Primary Examiner* — Jonathan R Matthias
(74) *Attorney, Agent, or Firm* — Carlos M. Téllez Rodríguez; 3M Innovative Properties Co

(57) ABSTRACT

A thermal insulation structure comprising a first member, a second member, a mat material and an inorganic adhesive. The first member comprises a first surface having a temperature potentially reaching 200° C. or higher. The second member comprises a second surface disposed opposite to the first surface of the first member. The mat material is disposed between the first member and the second member. An area is formed on at least one of the first surface and the second surface, with the area including the inorganic adhesive. The inorganic adhesive exhibits adhesiveness upon being heated.

12 Claims, 4 Drawing Sheets

(56) References Cited

U.S. PATENT DOCUMENTS

| | | | | |
|---|---|---|---|---|
| 2002/0025904 | A1 | 2/2002 | Goto et al. | |
| 2003/0129102 | A1 | 7/2003 | Turek | |
| 2009/0049831 | A1 | 2/2009 | Yasuda et al. | |
| 2010/0186359 | A1* | 7/2010 | Dietz | F01N 3/2853 428/221 |
| 2010/0212275 | A1* | 8/2010 | Schmidt | F01N 3/2853 55/502 |
| 2014/0248189 | A1* | 9/2014 | Tomosue | F01N 3/2853 29/890 |
| 2017/0122180 | A1 | 5/2017 | Lee | |
| 2017/0204296 | A1* | 7/2017 | Malston | B32B 37/12 |

FOREIGN PATENT DOCUMENTS

| | | | | |
|---|---|---|---|---|
| EP | 2479395 | A1 | 7/2012 | |
| JP | 57061686 | A | 4/1982 | |
| JP | 2002066331 | A | 3/2002 | |
| JP | 2006223920 | A | 8/2006 | |
| WO | 2004061279 | A1 | 7/2004 | |
| WO | 2007030410 | A1 | 3/2007 | |
| WO | 2007143437 | A2 | 12/2007 | |
| WO | 2008154078 | A1 | 12/2008 | |
| WO | 2014160665 | A1 | 10/2014 | |
| WO | 2019246180 | A1 | 12/2019 | |
| WO | WO-2020044228 | A1 * | 3/2020 | F01N 3/286 |

* cited by examiner

THERMAL INSULATION STRUCTURE AND METHOD OF MAKING SAME

CROSS REFERENCE TO RELATED APPLICATIONS

This application is a national stage filing under 35 U.S.C. 371 of PCT/IB2020/061843 filed Dec. 11, 2020, which claims the benefit of Provisional Application No. 62/949,173, filed Dec. 17, 2019, the disclosure of which is incorporated by reference in its/their entirety herein.

TECHNICAL FIELD

The present disclosure relates to a thermal insulation structure (e.g., a pollution control apparatus), and a production method thereof.

BACKGROUND ART

Exhaust gas from an automobile engine contains carbon monoxide (CO), hydrocarbons (HC), nitrogen oxides (NOx), and the like. Exhaust gas from a diesel engine further contains a particulate matter such as soot. As a means to remove them, an exhaust gas cleaning system using a ceramic catalytic converter or a diesel particulate filter (DPF) is known. In addition, mounting of a gasoline particulate filter (GPF) has also been investigated. These devices are generally called a pollution control apparatus.

In general, a pollution control apparatus (e.g., a ceramic catalytic converter) includes a pollution control element (e.g., a honeycomb-shaped catalyst carrier made of ceramic), a casing made of metal that encases the pollution control element, and a holding material packed in a gap between an outer circumferential surface of the pollution control element and an inner surface of the casing. The holding material holds the pollution control element in the casing to prevent mechanical shock due to impact, vibration, and the like from being inadvertently applied to the pollution control element. The holding material prevents the pollution control element from moving and breaking in the casing, providing desirable effects throughout an operating life of the pollution control element. This type of the holding material is also commonly called a mounting material. Such a holding material is generally a mat-like material including a single layer or multiple layers, and is used by being wrapped around the pollution control element.

The holding material generally includes inorganic materials such as inorganic fibers as a main constituent from the viewpoint of achieving excellent thermal insulation and heat resistance. Such a holding material (mounting material) is described, for example, in Patent Documents JP 57-61686 A, JP 2002-66331 A, and JP 2006-223920 A.

SUMMARY OF INVENTION

A holding material, in the art of mounting pollution control elements in the casing of a pollution control apparatus, has been designed to prevent a shift in position during use mainly by a compression repulsive force and friction force of the holding material. Most such holding material exhibit a coefficient of friction in the range of from 0.4 to 0.5 at 600° C., at the surface in contact with one or both of the casing or pollution control element. That is, a technique has been introduced, wherein a holding material, after it is encased together with a pollution control element in a casing, holds the pollution control element by a compression repulsive force on a surface of the other member (i.e., an inner surface of the casing and/or an outer surface of the pollution control element) with which the holding material is in contact such that the pollution control element does not move from a predetermined position.

An object of the present disclosure is to provide a thermal insulation structure used under a heating environment. The thermal insulation structure comprises a first member and a second member, with a mat material disposed between the first and second members so as to insulate one member from the other. An inorganic adhesive is used to suppress a relative shift in position of the mat material and one or both of the members during use of the structure in the heating environment. Another object of the present disclosure is to provide a method of producing such a thermal insulation structure. An additional object of the present disclosure is to provide one or more uses of such structure (e.g., a pollution control apparatus).

One aspect of the present disclosure relates to a thermal insulation structure. The thermal insulation structure comprises a first member, a second member, a mat material and an inorganic adhesive. The first member comprises a first surface having a temperature potentially reaching 200° C. or higher. The second member comprises a second surface disposed opposite to the first surface of the first member. The mat material is disposed between the first member and the second member. An area is formed on at least one of the first surface and the second surface, with the area including the inorganic adhesive. The inorganic adhesive exhibits adhesiveness upon being heated.

Another aspect of the present disclosure relates to a thermal insulation structure in the form of a pollution control apparatus. With such a thermal insulation structure, the first member is a pollution control element, the second member is a casing, the pollution control element is provided in the casing, and the mat material is disposed between the casing and the pollution control element.

An additional aspect of the present disclosure relates to a method of producing a thermal insulation structure. The method comprises: providing a first member comprising a first surface having a temperature potentially reaching 200° C. or higher; providing a second member comprising a second surface disposed opposite to the first surface of the first member; coating a solution containing an inorganic adhesive onto at least a part of at least one of the first surface and the second surface; and drying the solution so that the inorganic adhesive is substantially dry on and bonded to at least part of at least one of the first surface and the second surface.

According to the present disclosure, an apparatus or a structure used under heating environment is provided, where relative movement between members thereof can be completely prevented or significantly suppressed.

DESCRIPTION OF EMBODIMENTS

Embodiments of the present disclosure will be described below in detail with reference to the drawings.

Figure 1:
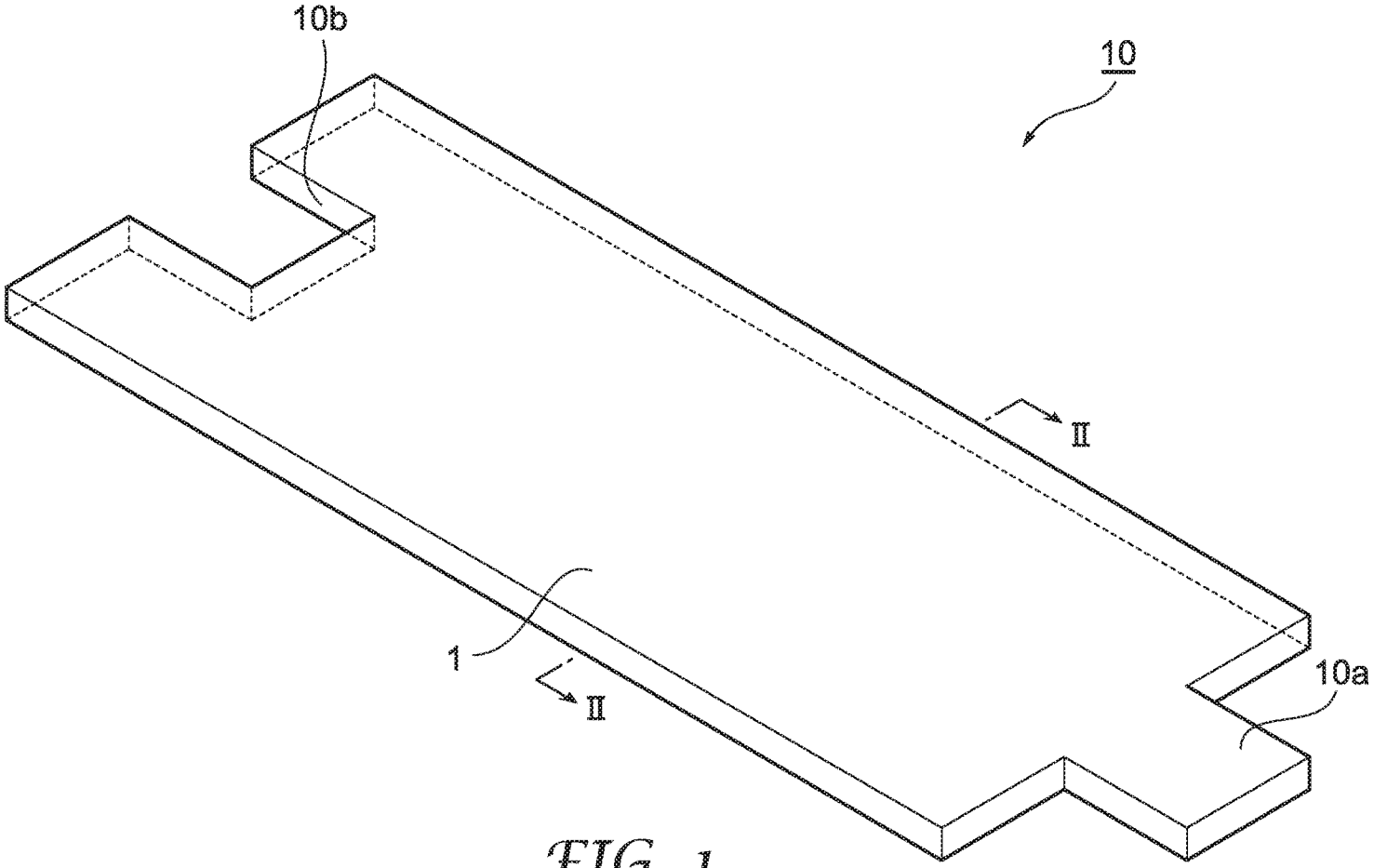
FIG. 1 is a perspective view illustrating one embodiment of a mat material can may be used with the present disclosure.
Figure 2:
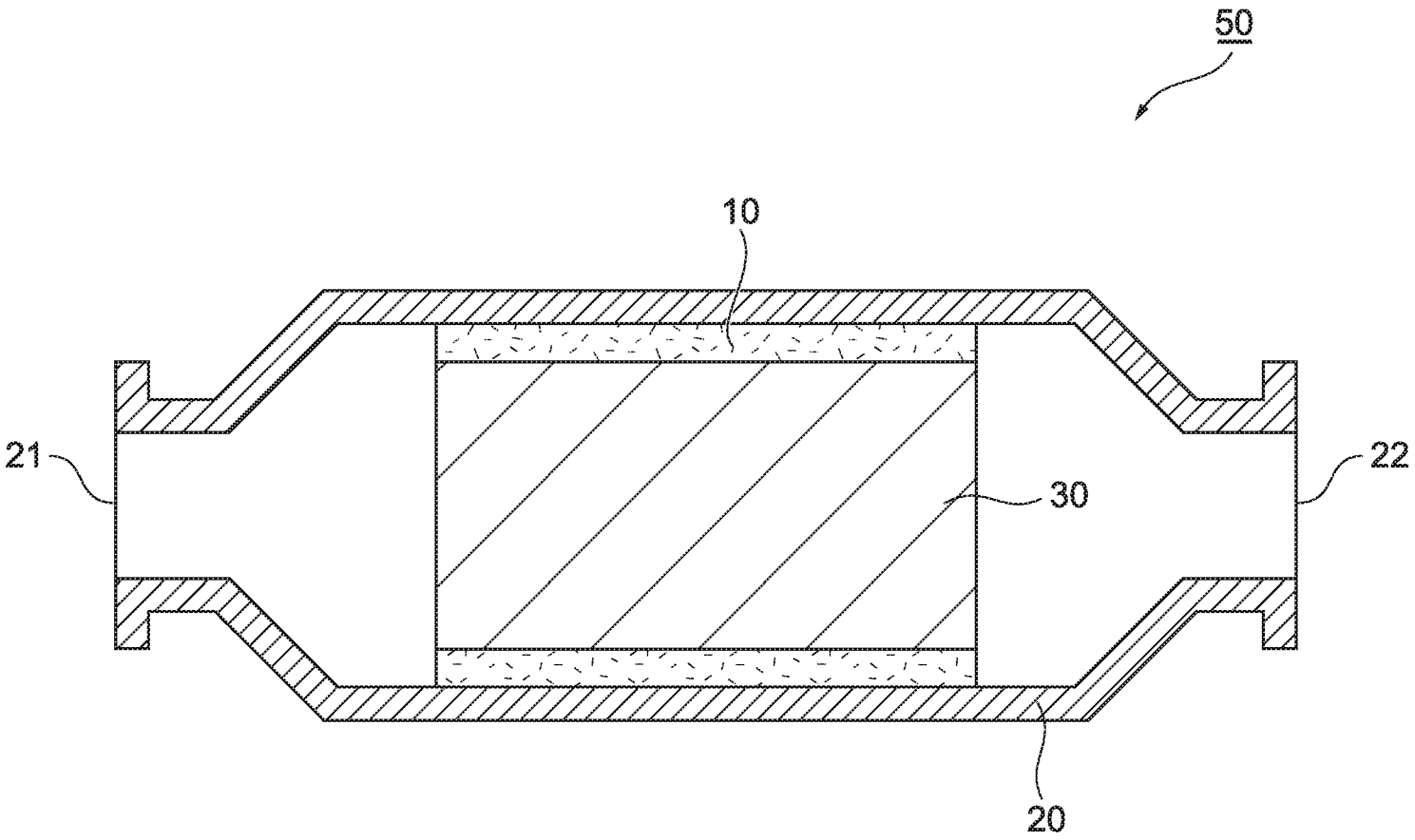
FIG. 2 is a cross sectional view schematically illustrating one embodiment of a pollution control apparatus according to the present disclosure.

FIG. 1 is a perspective view illustrating an example of a mat material configured to be wrapped around a pollution control element 30 having a round cylindrical or elliptical cylindrical outer shape and to mount and thermally insulate the pollution control element 30 in a casing 20 (refer to FIG. 2). The mat material 10 has a length that is in accordance with the length of the outer circumference of the pollution control element 30. The mat material 10 has a convex part 10*a* on one end, and a concave part 10*b* on the other end, for example, and has a shape such that the convex or tong part 10*a* and the concave or groove part 10*b* mutually mate when the mat material 10 is wrapped around the pollution control element 30. Note that other shapes such as an L shape are also possible, and the shape for the mating is not particularly limited.

Figure 3:
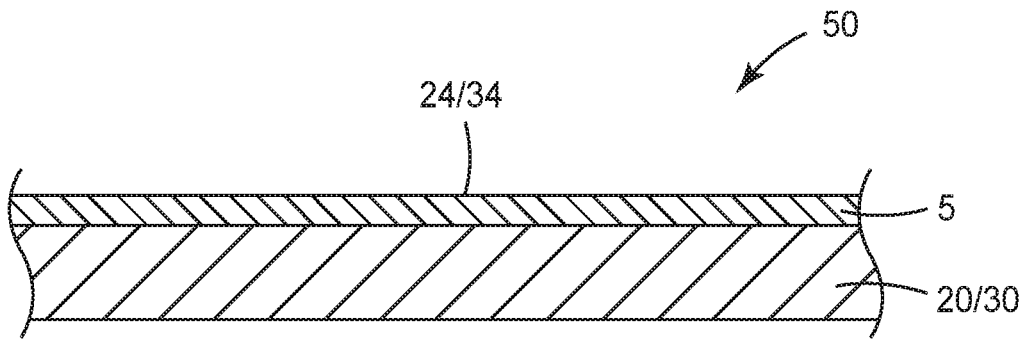
FIG. 3 is a schematic cross-sectional view of the pollution control element or casing of the pollution control apparatus of FIG. 2, with a surface layer according to the present disclosure.

As illustrated in FIG. 3, a surface layer 5 (area containing an inorganic adhesive) is provided on a first surface 34 of a first member 30 (e.g., an outer surface of a pollution control element 30), on a second surface 24 of a second member 20 (e.g., an inner surface of a pollution control apparatus casing 20), or on both surfaces 34 and 24. It can be desirable for each surface layer 5 to have a thickness in the range of from about 5 to about 15 mm. A mat material 10 (see, e.g., FIG. 2) is disposed between the member surfaces 24 and 34, with each adhesive surface layer 5 being disposed between the mat material and the corresponding member. The mat material 10 includes inorganic fibers, which can have a diameter (e.g., an average diameter) in the range of from about 3 to about 10 μm. The mat material can also include other components compounded as necessary. Each surface layer 5 includes an inorganic adhesive exhibiting adhesiveness upon being heated, and optionally other components compounded as necessary. Note that the surface layer 5 is only on one surface of its corresponding member. Alternatively, the surface layer 5 can be on only a portion or part of the area of one surface or both surfaces 24 and 34. In addition, FIG. 3 illustrates a state, in which a surface layer 5 is laminated on and adhered to one or both of the surface 24 and the surface 34, but each surface layer 5 is also adhered to and impregnated into the body portion of the mat material 10.

As mentioned above, the surface layer(s) 5 contains an inorganic adhesive exhibiting adhesiveness upon being heated. Inorganic adhesives described herein include those providing not only adhesion by the formation of reaction products with other members upon being heated, but also adhesion due to anchoring effect (fixed or adhered state), resulting from fluidity exhibited by an inorganic adhesive of the surface layer 5 upon being heated, and penetration into contact surfaces of the mat material 10 or other members. The temperature at which adhesiveness is exhibited is not limited, but adhesiveness is exhibited, for example, at 200° C. or higher, 300° C. or higher, or 600° C. or higher. For example, the mat material 10 is arranged in a sandwiched state between the two members and is allowed to stand under a temperature condition of 600° C. for 1 hour. Then, the mat material 10 exhibits adhesiveness to other members. Exhibition of adhesiveness can be visually judged by checking whether a fixed or adhered area is formed between the mat material 10 and one, or the other or both members after the heated mat material 10 is cooled (see FIGS. 5 and 6). Such adhesiveness can result in the mat material 10 exhibiting a coefficient of friction of 0.75 or higher at 600° C., at the surface in contact with one or both of the first member and second member.

The inorganic adhesive is generally in a liquid state at ordinary temperature, but the surface layer 5 is substantially dry on a corresponding structure member (e.g., members 20 or 30). Note that "substantially dry" herein refers to, for example, a dry state obtained by a drying process after coating the inorganic adhesive; for such a dry state, the mass loss after heating the mat material 10 at 120° C. for 30 min is within about 5% based on the mass of the mat material 10 before heating. The surface layer 5, as being substantially dry, has an advantage of excellent workability when assembling the components (e.g., members) of the thermal insulation structure or device.

The above-mentioned inorganic adhesive is, for example, at least one salt selected from the group consisting of an alkali metal salt, an alkaline earth metal salt, and a phosphate salt. Specific examples of alkali metal salts include alkali metal silicates, such as sodium silicate, potassium silicate, and lithium silicate. Specific examples of alkaline earth metal salts include alkaline earth metal silicates, such as magnesium silicate and calcium silicate. Specific examples of phosphate salts include aluminum phosphate, magnesium phosphate, and calcium phosphate. One type of these components may be alone, or combination of two or more types may be used.

A liquid containing the above-mentioned inorganic adhesive may be coated on the surface of either structure member 20 and 30, followed by the drying process to form the surface layer 5. The content of the inorganic adhesive (the above-mentioned salts) in the surface layer 5 is, for example, from 1 to 50 g/m$^2$, and may be from 2 to 40 g/m$^2$ or from 5 to 30 g/m$^2$. The amount of the inorganic adhesive in the surface layer 5 may be set as appropriate depending on adhesiveness required for the mat material 10 to the desired member(s) 20 and/or 30.

The surface layer 5 may contain inorganic colloidal particles. While various types of fine particles of inorganic materials can be used to form the inorganic colloidal particles, preferred inorganic materials include metal oxides, nitrides, and carbides, as well as materials preferably having heat resistance. For example, preferred examples include, but not limited to, silica, alumina, mullite, zirconia, magnesia, and titania. Examples of other suitable materials include boron nitride and boron carbide. Those inorganic materials may be used individually or in combination of two or more thereof.

While above-mentioned inorganic colloidal particles can be used in various particle sizes in accordance with the type of the inorganic material and the desired friction-improving effect, it is generally preferred that they have an average particle size from about 1 to 100 nm. In a case where the inorganic colloidal particles have an average particle size of less than 1 nm, such inorganic colloidal particles are incapable of forming a friction layer that can contribute to the friction-increasing effect. In contrast, in a case where the inorganic colloidal particles have an average particle size greater than 100 nm, the particles may be too large to appropriately contribute to increasing the friction and result in falling off. The average particle size of the inorganic colloidal particles is more preferably in the range from about 10 to 80 nm, and most preferably in the range from about 20 to 50 nm. With regard to the inorganic colloidal particles, WO 2007/030410 may be referenced, which is incorporated by reference herein in its entirety.

The inorganic adhesive may also comprise inorganic fillers such as clays (kaolin), boehmite, titanium dioxide, fumed silica, fumed alumina, precipitated silica, ATH and other compatible common fillers to modify viscosity and absorption properties. The inorganic adhesive may also contain humectants such as glycerin, sorbitol, other sugar alcohols, and ethylene glycol. These materials can help plasticize the inorganic adhesive to improve handling properties. Compatible dyes and pigments may also be incorporated to help identify the presence and location of the inorganic adhesive. Compatible surfactants can also be included to help wet the surfaces where adhesion is desired.

The surface layer 5 may further contain inorganic fibers as necessary. Diameters of the inorganic fibers may be from about 1 nm to about 15 nm, they are, for example, about 1 nm or greater, about 2 nm or greater, or about 3 nm or greater, and may be about 15 nm or smaller, about 8 nm or smaller, or about 5 nm or smaller. Inorganic fibers having a diameter of about 1 nm or greater have the advantage of being easily available compared to inorganic fibers thinner than 1 nm. In addition, during production of the pollution control apparatus, such inorganic fibers tend to be able to suppress scattering of the fiber pieces. On the other hand, inorganic fibers having a diameter of about 15 nm or smaller tend to be able to suppress the generation of fiber pieces during production of the device compared to inorganic fibers thicker than about 15 nm. The average length of the inorganic fibers is, for example, from about 500 to about 5000 nm, and may be from about 1000 to about 4000 nm or from about 1400 to about 3000 nm.

The diameter (average diameter) and average length (average fiber length) of the inorganic fibers can be determined by measuring the thicknesses and lengths of e.g., 50 or more fibers randomly sampled from microscopic images (TEM images, SEM images, and the like), and calculating the average values thereof. The aspect ratio of the inorganic fibers is calculated by dividing the value of the average length by the value of the diameter.

The average length of the above-mentioned inorganic fibers can be, for example, from about 60 to about 2000, and may be from about 100 to about 1500 nm or from about 300 to about 800 nm. Inorganic fibers with an aspect ratio of about 60 or greater tend to be able to suppress the scattering of fiber pieces during production of the device compared to inorganic fibers having a smaller aspect ratio than about 60. On the other hand, inorganic fibers with an aspect ratio of about 2000 or smaller have the advantage of being easily available compared to inorganic fibers having a larger aspect ratio than about 2000. With regard to the inorganic fibers, JP 2017-210815 may be referenced.

The body portion of the mat material can mainly constitute of the inorganic fibers. Specific examples of the inorganic fibers constituting the body portion of the mat material can include glass fibers, ceramic fibers, carbon fibers, silicon carbide fibers, and boron fibers, but other inorganic fibers may be used as necessary. One type of the inorganic fibers selected from those listed above may be alone or combination of two or more types may be used. Also, the inorganic fibers may be used in the form of composite fibers. Particularly preferred among them are ceramic fibers such as alumina fibers, silica fibers, and alumina-silica fibers. One type of the ceramic fibers may be used alone or combination of two or more types may be used. Also, the ceramic fibers may be used in the form of composite fibers. Intumescent materials such as unexpanded vermiculite may also be contained within the body portion of the mat material in a concentration from about 5 to about 50% of the total body portion weight.

The body portion of the mat material can contain mainly inorganic fibers, with an organic binder as an optional additive. There are two representative production methods for making the mat material, a dry process and a wet process.

In the dry process, for example, an alumina fiber precursor is obtained first, by spinning a sol-gel including a mixture of an alumina source such as aluminum oxychloride, a silica source such as silica sol, an organic binder such as polyvinyl alcohol, and water. This is followed by laminating the alumina fiber precursor in a sheet form, then needle-punching the laminate, and baking at a high temperature ranging from about 1000 to 1300° C. to obtain the body portion. The needle-punching density is, for example, from about 1 to 50 punches/$cm^2$, and by changing this density, the thickness, bulk specific gravity, and strength of the mat can be adjusted. On the other hand, in the wet process, the body portion is obtained by mixing the inorganic fibers and the organic binder as starting materials with an optional additive, followed by continuously performing the steps of opening the inorganic fibers, preparing a slurry, molding by paper making, applying pressure to the mold, and the like. For details about the wet process (wet lamination process), WO 2004/061279 and U.S. Pat. No. 6,051,193 may be referenced, which are incorporated herein by reference in their entirety. Note that the type and the amount used of the organic binders are not particularly limited. For example, acrylic resins, styrene-butadiene resins, acrylonitrile resins, polyurethane resins, natural rubber, polyvinyl acetate resins, and the like, provided in the form of latex, can be used as the organic binders. Alternatively, thermoplastic resins such as unsaturated polyester resins, epoxy resins, polyvinyl ester resins may be used as the organic binders.

The method of producing an embodiment of the thermal insulation structure includes: providing one or both member 20 and 30; coating a liquid containing an inorganic adhesive onto at least one of the first surface 24 of the first member 20 or the second surface 34 of the second member 30, or both; and applying heat to the liquid, after being coated as mentioned above. According to the above-mentioned production method, one or each structure member, with the surface layer 5 formed on at least one surface thereof, can be obtained.

In a case where the mat material contains the inorganic fine particles therein, the composition of the colloidal solution may be preferably adjusted in the step (a) such that the content of the fine particles is from about 1 to about 10 mass % based on the total mass of the body portion. With the content of the inorganic fine particles about 1 mass % or greater, a sufficient surface pressure is readily obtained, and with the content of the inorganic fine particles about 10 mass % or less. Without the adhesive being adhered thereto, the mat material 10 can have a flexibility sufficient to more easily conform to the surfaces of the members (e.g., be wrapped around the pollution control element).

Note that a step of drying the structure member(s) coated with the colloidal solution is performed as necessary. Also note that such drying of the colloidal solution can be performed together with other drying steps. For example, such a step can also be combined with the drying step of the inorganic adhesive, which is to be performed after the step of forming the surface layer 5. Alternatively, such a step can also be combined with the drying step after coating other solutions. The drying of the colloidal solution is done, for example, in a warm air dryer set at about 80 to about 250° C. for about 10 to about 180 min.

The liquid used for the formation of the surface layer 5 contains the inorganic adhesives and components (inorganic fibers and/or inorganic fine particles) that are compounded as necessary. Coating of the liquid onto the surface of the body portion may be performed, for example, by spray coating, roll coating, film transfer, curtain coating, and the like. The coating amount per unit area (mass of solid) may be, for example, in the range of from about 1 to about 200 $g/m^2$, in one embodiment. Additionally, the coating amount may also be in the range of from about 10 to about 175 $g/m^2$, in one embodiment. The coating amount may also be in the range of from about 20 to about 150 $g/m^2$. The coating amount per unit area (mass of solid) may also be, for example, in the range of from about 1 to about 400 $g/m^2$. It may be desirable for the coating amount per unit area to be in the range of from about 50 to about 350 $g/m^2$, about 100 to about 300 $g/m^2$, or about 150 to about 250 $g/m^2$. The drying step after coating is for forming the surface layer 5 by volatilizing water. For example, the structure member 20 and/or 30, after being coated with the solution, may be dried in a warm air dryer set at about 75 to about 250° C. for about 10 to about 180 min. Thereby, the surface layer 5 is formed on the surface of the corresponding member. The coating of the inorganic adhesive may be in any desired form on the surface of the member such as, for example, in a pattern of stripes, dots, or any other desired design, and the like.

The step of forming the surface layer 5 may be divided into a plurality of steps and performed. For example, first, the liquid containing the inorganic adhesive may be coated onto the surface of the corresponding member, and then the liquid containing other components may be coated onto the surface of the corresponding member. The order may be reversed, i.e., first, the liquid containing other components may be coated onto the surface of the corresponding member, and then the liquid containing the inorganic adhesive may be coated onto the surface of the corresponding member. The inorganic adhesive may be applied to either a wet or dry member.

The mat material 10 is used, as illustrated in FIG. 2, to mount a pollution control element 30 in a pollution control apparatus 50. Specific examples of the pollution control element 30 include a catalyst carrier, a filter element, and the like for cleaning exhaust gases from engines. Specific examples of the pollution control apparatus 50 include a catalytic converter and an exhaust cleaning device (e.g., a diesel particulate filter device). The pollution control apparatus 50 includes a casing 20, with the pollution control element 30 provided in the casing 20, and the mat material 10 disposed between an inner surface of the casing 20 and an outer surface of the pollution control element 30. The pollution control apparatus 50 further includes a gas flow inlet 21 that introduces exhaust gas to the pollution control element 30; and a gas flow outlet 22 that discharges exhaust gas that has passed through the pollution control element 30.

In the pollution control apparatus 50, the mat material 10 is disposed in a sandwiched state between the inner surface of the casing 20 and the outer surface of the pollution control element 30. The width of the gap between the inner surface of the casing 20 and the outer surface of the pollution control element 30 is preferably from about 1.5 to about 15 mm from the viewpoint of ensuring airtightness and reducing the use amount of the mat material 10. The mat material 10 is preferably in a state of being appropriately compressed such that the mat material 10 can be fixed or adhered to other members abutting thereon upon being heated. In one embodiment, the mat material 10 is fixed to the inner surface of the casing 20 and to the outer surface of the pollution control element 30, and thus the shift in position of the pollution control element 30 in the pollution control apparatus 50 can be highly suppressed. In addition, the bulk density of the mat material can be set lower compared to mat materials in the related art, and thus the amount of the relatively expensive inorganic fiber material used can be reduced. Examples of the technique for compressing and assembling the mat material 10 include the clamshell technique, stuffing technique, and tourniquet technique.

The pollution control element 30 reaches a high temperature upon passage therethrough of a high-temperature exhaust gas. The portion between the pollution control element 30 and the mat material 10 is heated to as high as 200 to 1100° C. On the other hand, the portion between the mat material 10 and the casing 20 is heated to as high as 100 to 800° C. The pollution control apparatus 50 includes the mat material 10 having the surface layer 5 that exhibits adhesiveness upon being heated, and thus can firmly hold the pollution control element 30 in the casing 20. A catalyst to be carried by the catalyst carrier is generally a metal (e.g., platinum, ruthenium, osmium, rhodium, iridium, nickel, and palladium) and a metal oxide (e.g., vanadium pentoxide, and titanium dioxide), and is preferably used in a form of coating. Note that the pollution control apparatus can be constructed as a diesel particulate filter or a gasoline particulate filter by applying a filter element in place of the catalyst carrier.

Figure 4:
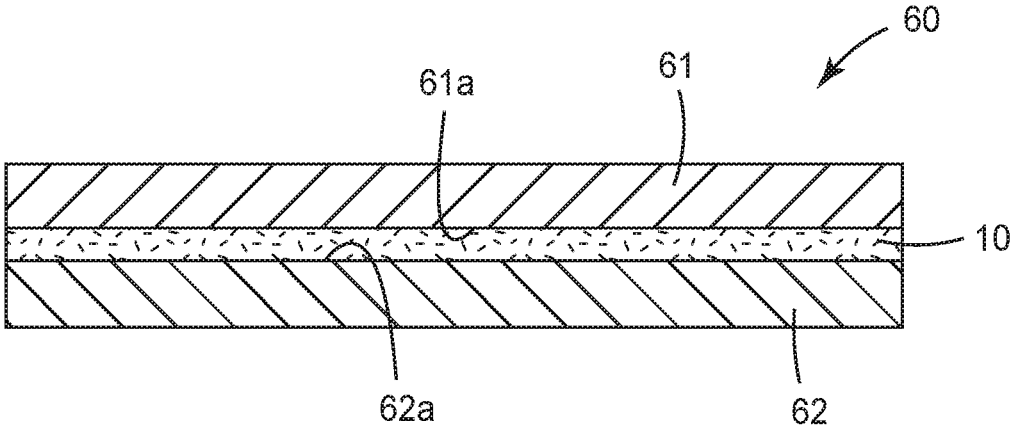
FIG. 4 is a cross sectional view schematically illustrating the thermal insulation structure according to the present disclosure.

Embodiments of the present disclosure have been described in detail, but the present invention is not limited to the above-mentioned embodiments. For example, the above-mentioned embodiments have been illustrated by the examples where the mat material 10 is applied to the pollution control apparatus, but the mat material 10 may be applied to any other thermal insulation structure including a heat source, such as an exhaust manifold and an exhaust pipe, or an exhaust system part through which a high-temperature fluid flows, and a heat shield cover installed therearound. As briefly illustrated in FIG. 4, a thermal insulation structure 60 includes: a first member 61 (e.g., a heat source or an exhaust system part through which a high-temperature fluid flows) having a surface 61*a* having a temperature potentially reaching 200° C. or higher; a second member 62 (e.g., a heat shield cover) having a surface 62*a* opposite to the surface 61*a* of the first member 61; and a mat material 10 disposed between the first member 61 and the second member 62. A heat from the first member 61, which can raise the temperature not lower than 200° C., prompts inorganic adhesive on the surface 61*a* to exhibit adhesiveness between the first member 61 and the mat material 10. Heat from the first member 61 may also prompt inorganic adhesive on the surface 62*a*, when located on that surface, to exhibit adhesiveness between the second member 62 and the mat material 10, when the temperature on the surface 62*a* is raised to not lower than 200° C. Adhesiveness of the inorganic adhesive can suppress the shift in position of the mat material 10 in the thermal insulation structure 60.

Additional Embodiments

1. A thermal insulation structure comprising a first member, a second member, a mat material and an inorganic adhesive. The first member comprises a first surface having a temperature potentially reaching 200° C. or higher. The second member comprises a second surface disposed opposite to the first surface of the first member. The mat material is disposed between the first member and the second member. An area is formed on at least one of the first surface and the second surface, with the area including the inorganic adhesive. The inorganic adhesive exhibits adhesiveness upon being heated.

Preferably, the inorganic adhesive only exhibits adhesiveness (i.e., tacky enough to form an adhesive bond to a member surface) upon being heated to a temperature above room temperature (i.e., above 24° C.) or ambient temperature (i.e., in the range of from 24° C. up to 46° C.). It can be desirable for the inorganic adhesive to only exhibit adhesiveness upon being heated to a temperature of at least 50° C., 75° C., 100° C., 125° C., 150° C., 175° C., 200° C. or higher.

2. The thermal insulation structure according to embodiment 1, wherein the inorganic adhesive is substantially dry.

3. The thermal insulation structure according to embodiment 1 or 2, wherein the inorganic adhesive contains at least one salt selected from the group consisting of an alkali metal salt, an alkaline earth metal salt, and a phosphate salt.

4. The thermal insulation structure according to embodiment 3, wherein the alkali metal salt is an alkali metal silicate.

5. The thermal insulation structure according to embodiment 4, wherein the alkali metal silicate is at least one selected from the group consisting of sodium silicate, potassium silicate, and lithium silicate.

6. The thermal insulation structure according to embodiment 3, wherein the phosphate salt is at least one selected from the group consisting of aluminum phosphate, magnesium phosphate, and calcium phosphate.

7. The thermal insulation structure according to embodiment 3, wherein the content of the salt is from 1 to 50 g/m$^2$ in the area containing the inorganic adhesive.

8. The thermal insulation structure according to any one of embodiments 1 to 7, wherein the area containing the inorganic adhesive is formed on both of the first surface and the second surface.

9. The thermal insulation structure according to any one of embodiments 1 to 8, wherein the area containing the inorganic adhesive is formed on an entire surface of at least one of the first surface and the second surface.

10. The thermal insulation structure according to any one of embodiments 1 to 8, wherein the area containing the inorganic adhesive is formed on a part of at least one of the first surface and the second surface.

11. The thermal insulation structure according to any one of embodiments 1 to 10, wherein the area containing the inorganic adhesive contains inorganic colloidal particles.

12. The thermal insulation structure according to embodiment 11, wherein the inorganic colloidal particles are alumina colloidal particles.

13. The thermal insulation structure according to any one of embodiments 1 to 12, wherein the mat material contains inorganic fibers with an aspect ratio from 60 to 2000.

14. The thermal insulation structure according to embodiment 13, wherein the inorganic fibers with an aspect ratio from 60 to 2000 are alumina fibers.

15. The thermal insulation structure according to any one of embodiments 1 to 14, wherein after heating the inorganic adhesive under a temperature condition of 600° C. for 1 hour, a fixed area is formed between the first surface of the first member and the mat material, between the mat material and the second surface of the second member, or both.

16. The thermal insulation structure according to any one of embodiments 1 to 15, wherein after heating the inorganic adhesive under a temperature condition of at least about 100-150° C. for at least about 10 minutes, a fixed area is formed between the first surface of the first member and the mat material.

17. The thermal insulation structure according to any one of embodiments 1 to 16, wherein after heating the inorganic adhesive under a temperature condition of at least about 100-150° C. for at least about 10 minutes, a fixed area is formed between the mat material and the second surface of the second member.

18. The thermal insulation structure according to any one of embodiments 3 to 14, wherein the content of the salt is from 1 to 400 g/m$^2$ in the area containing the inorganic adhesive.

19. The thermal insulation structure according to any one of embodiments 1 to 18, wherein the thermal insulation structure is a pollution control apparatus, with the first member being a pollution control element, the second member being a casing, the pollution control element being provided in the casing, and the mat material is disposed between the casing and the pollution control element.

20. The thermal insulation structure according to any one of embodiments 19, wherein after heating the inorganic adhesive under a temperature condition of 600° C. for 1 hour, a fixed area is formed between an inner surface of the casing and an outer surface of the mat material, between an inner surface of the mat material and an outer surface of the pollution control element, or both.

21. The thermal insulation structure according to embodiment 19 or 20, wherein after heating the inorganic adhesive under a temperature condition of at least about 100-150° C. for at least about 10 minutes, a fixed area is formed between an inner surface of the casing and an outer surface of the mat material.

22. The thermal insulation structure according to any of embodiments 19 to 21, wherein after heating the inorganic adhesive under a temperature condition of at least about 100-150° C. for at least about 10 minutes, a fixed area is formed between an inner surface of the mat material and an outer surface of the pollution control element.

23. A method of producing a thermal insulation structure comprising: (a) providing a first member comprising a first surface having a temperature potentially reaching 200° C. or higher; (b) providing a second member comprising a second surface disposed opposite to the first surface of the first member; (c) coating a solution containing an inorganic adhesive onto at least a part of at least one of the first surface and the second surface; and (d) drying the solution so that the inorganic adhesive is substantially dry on and bonded to at least part of at least one of the first surface and the second surface.

24. The method according to embodiment 23, wherein the inorganic adhesive exhibits adhesiveness upon being heated.

25. The method according to embodiment 23 or 24, further comprising disposing a mat material between the first surface of the first member and the second surface of the second member so that the mat material contacts at least part of the dry inorganic adhesive.

26. The method according to embodiment 23 or 24, further comprising disposing a mat material between the first surface of the first member and the second surface of the second member, before said drying, so that the inorganic adhesive is wet and the mat material contacts at least part of the wet inorganic adhesive.

27. The method according to any one of embodiments 23 to 25, further comprising heating the inorganic adhesive so as to bond the mat material to at least one of the first surface and the second surface.

EXAMPLES

The present disclosure will be described with reference to examples thereof. It is needless to say that the present invention is not limited by these examples.

Preparation of Body Portion

Chemicals listed below were introduced to 10 L of water while stirring at an interval of 1 min to prepare a colloidal solution containing an organic binder and inorganic fine particles.

(1) Aluminum sulfate (aqueous solution with a solid content concentration of 40%): 6 g
(2) Organic binder (Acrylic Latex LX874 (trade designation), available from Zeon Corporation): 2.6 g
(3) Colloidal silica (Snowtex O (trade designation), available from Nissan Chemical Industries, Ltd.): 10 g
(4) Liquid sodium aluminate (solid content 40%): 3.5 g A needle-punched alumina fiber blanket (Maftec MLS-2 Blanket (trade designation), available from Mitsubishi Chemical Corporation) was cut out in 15 cm×40 cm. This was placed on a metal mesh, the above-mentioned colloidal solution was poured from above, and then water was removed by aspiration on the metal mesh for 15 sec. Thus, the above-mentioned colloidal solution was impregnated into the blanket, and then a drying process was performed in a warm air dryer set at a temperature of 170° C. for 45 min. Thereby, the body portion of the mat material was prepared.

Aqueous Solution Containing Inorganic Adhesive

Aqueous solution 1: An aqueous solution of sodium silicate (Sodium Silicate No. 3, available from Fuji Kagaku Corp.) diluted to a concentration of 50% was prepared.

Aqueous solution 2: An aqueous solution of aluminum phosphate (WR-100B, available from Taki Chemical Co., Ltd.) diluted to a concentration of 50% was prepared.

Example 1

The aqueous solution 1 (sodium silicate aqueous solution) is coated onto the first surface (outer surface) of the pollution control element, as follows: The aqueous solution 1 is spray-coated onto the entire area of the first surface to a coated amount of 20 g/m$^2$ in terms of solid content. Then a drying process is performed in a warm air dryer set at a temperature of 170° C. for 5 min. Thereby, an area containing the inorganic adhesive is formed on the entire area of the first surface. In the same manner as above, an area containing the inorganic adhesive is formed also on the entire surface of the second surface (inner surface) of the casing.

Example 1a

Members according to this example are prepared in the same manner as in Example 1 except that the coated amounts (in terms of solid content) of the aqueous solution 1 (sodium silicate aqueous solution) onto the first and second surfaces were 2 g/m$^2$ each instead of 20 g/m$^2$ each.

Example 1b

Members according to this example are prepared in the same manner as in Example 1 except that the coated amounts (in terms of solid content) of the aqueous solution 1 (sodium silicate aqueous solution) onto the first and second surfaces were 40 g/m$^2$ each instead of 20 g/m$^2$ each.

Example 2

Members according to this example are prepared in the same manner as in Example 1 except that the aqueous solution 2 (aluminum phosphate aqueous solution) was used instead of the aqueous solution 1 (sodium silicate aqueous solution).

Comparative Example 1

Everything is the same as in Example 1, except there is no area containing the inorganic adhesive.

Assessment of Adhesiveness upon Being Heated

Figure 5:
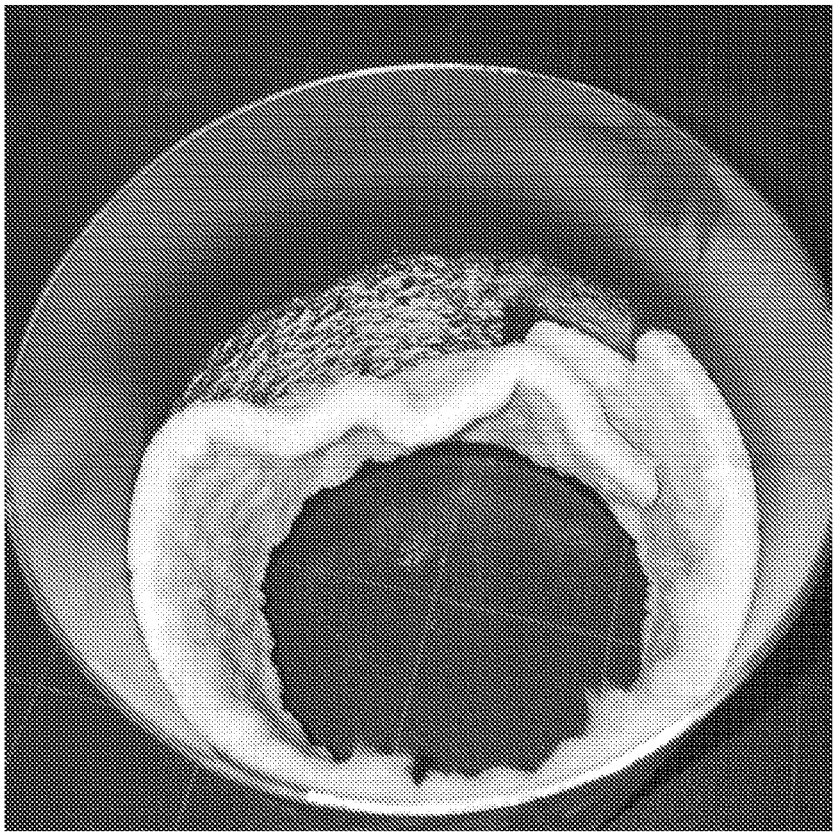
FIG. 5 is a photograph showing a state where a part of the mat material (using aluminum phosphate as an inorganic adhesive) is fixed or bonded to an inner surface of the casing.

Whether the mat materials of the above-mentioned Examples and Comparative Example exhibit adhesiveness upon being heated was assessed as follows: The mat material was cut out in a width of 75 mm and a length of 350 mm, and wrapped around an outer circumference of a cylindrical-shaped catalyst carrier member (HONEYCERAM (trade designation), available from NGK Insulators, Ltd.) having a length of 115 mm and an outer diameter of 105 mm. This was press fitted at 40 mm/sec into a cylindrical stainless steel casing member having a length of 150 mm and an inner diameter of 114 mm using a guide cone. Thus, prepared converter samples were heated at 600° C. for 1 hour, and then the catalyst carriers were pulled out such that the mat material and the casing did not shift in position: those samples where a part of the mat material was fixed to the inner surface of the casing thereafter were assessed as having adhesiveness to the casing. The results are shown in Table 1. Note that FIG. 5 is a photograph showing a state where a part of the mat material is fixed to the inner surface of the casing.

Figure 6:
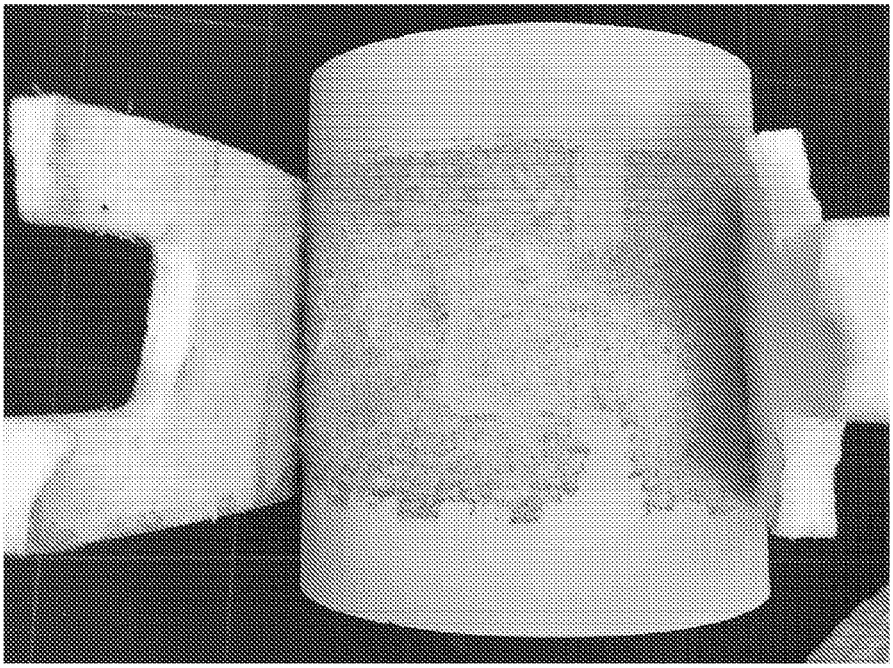
FIG. 6 is a photograph showing a state where a part of the mat material (using sodium silicate as an inorganic adhesive) is fixed or bonded to an outer surface of a catalyst carrier.

The converter samples prepared in the same manner as described above were heated at 600° C. for 1 hour, and then these were pulled out of the casings such that the mat material and the catalyst carrier did not shift in position. Those samples where a part of the mat material was fixed to the outer surface of the catalyst carrier thereafter were assessed as having adhesiveness to the catalyst carrier. The results are shown in Table 1. Note that FIG. 6 is a photograph showing a state where a part of the mat material is fixed to the outer surface of the catalyst carrier.

TABLE 1

| | | Example 1 | Example 1a | Example 1b | Example 2 | Comparative Example 1 |
|---|---|---|---|---|---|---|
| Inorganic adhesive | Type | Sodium silicate | Sodium silicate | Sodium silicate | Aluminum phosphate | — |
| | Coated amount (g/m$^2$, solid) | 20 | 2 | 40 | 20 | — |
| Presence of adhesiveness | Inner surface of casing | Yes | Yes | Yes | Yes | No |
| | Outer | Yes | Yes | Yes | Yes | No |

TABLE 1-continued

| | Example 1 | Example 1a | Example 1b | Example 2 | Comparative Example 1 |
|---|---|---|---|---|---|
| surface of catalyst carrier | | | | | |

Example 3

A colloidal solution was prepared by diluting alumina sol AS520 (available from Nissan Chemical Industries, Ltd., solid concentration: 20 mass %) with water to a solid concentration of 5 mass %. This colloidal solution was coated onto the first surface (carrier side surface) of the first member as follows: The aqueous solution 1 was coated by a Spray Gun PS-9513 (trade designation, available from Anest Iwata Corporation) onto the first surface at a coated amount of 5 g/m$^2$ in terms of solid content. Then, in the same manner as in Example 1, the aqueous solution 1 (sodium silicate aqueous solution) was spray-coated onto the first surface at a coated amount of 20 g/m$^2$ in terms of solid content. Then the drying process was done in a warm air dryer set at a temperature of 170° C. for 5 min. Thereby, an area containing the inorganic fibers and the inorganic adhesive was formed on the entire surface of the first surface. In the same manner as above, an area containing the inorganic adhesive was formed also on the second surface of the second member.

Example 4

Areas containing the inorganic adhesive were formed on the first surface of the first member and the second surface of the second member in the same manner as in Example 3 except that the order of spraying the above-mentioned colloidal solution (alumina sol aqueous solution) and the aqueous solution 1 (sodium silicate aqueous solution) was changed; that is, the aqueous solution 1 (sodium silicate aqueous solution) was sprayed, and then the colloidal solution (alumina sol aqueous solution) was sprayed.

Measurement of Force Required for Pulling out Catalyst Carrier

Pull-out force of the catalyst carrier was measured on the mat materials according to Examples 1 to 4 and Comparative Example 1 as follows: A heater was installed such that an outer surface of a cylindrical-shaped catalyst carrier member (HONEYCERAM (trade designation), available from NGK Insulators, Ltd.) having a length of 115 mm and an outer diameter of 105 mm could be heated. The mat material was cut out in a width of 75 mm and a length of 350 mm, and wrapped around an outer circumference of the catalyst carrier member. This was press fitted at 40 mm/sec into a cylindrical stainless steel casing member having a length of 150 mm and an inner diameter of 114 mm using a guide cone. After 24 hours of the press fitting, this was heated and the temperature between the catalyst carrier and the mat material reached 900° C., and the temperature between the mat material and the casing reached 600° C. After these temperatures were reached, the force (N) was measured when pulling out the catalyst carrier from the stainless steel casing at 40 mm/sec. From the maximum force (N) during the measurement, the force required to pull out the catalyst carrier (force per unit area of the mat material in N/cm$^2$) was calculated. The results are shown in Table 2.

TABLE 2

| | | Example 1 | Example 2 | Example 3 | Example 4 | Comparative Example 1 |
|---|---|---|---|---|---|---|
| Inorganic adhesive | Type | Sodium silicate | Sodium silicate | Sodium silicate | Aluminum phosphate | — |
| | Coated amount (g/m$^2$, solid) | 20 | 20 | 20 | 20 | — |
| Inorganic fibers | Alumina sol | — | — | Alumina sol | Alumina sol | — |
| | Coated amount (g/m$^2$, solid) | — | — | 5 | 5 | |
| Force required to pull out catalyst carrier (N/cm$^2$) | | 3.4 | 3.2 | 3.1 | 2.9 | 2.5 |

Example 5

The aqueous solution 1 (sodium silicate aqueous solution) is coated onto the first surface of the first member as follows: The aqueous solution was coated dropwise onto the surface to a coated amount of 20 g/m2 in terms of solid content. The drops were deposited across the width in rows with a spacing between the rows of ½ inch and a spacing between dots of ½ inch. Then a drying process was performed in a warm air drier set at a temperature of 170 C for 5 minutes. Thereby an area containing the inorganic adhesive was formed with discrete drops evenly distributed on the entire area of the first surface. In the same manner as above, an area containing the inorganic adhesive was formed with discrete drops evenly distributed on the entire area of the second surface of the second member.

While both surfaces were coated in Example 5, it is also contemplated that only the first or second surface could be coated. The amount applied to the surfaces could differ from that described in Example 5. The distance between the rows of dots could also differ, for example anywhere from about ¼ inch to about 2 inches.

Example 6

The aqueous solution 1 (sodium silicate aqueous solution) was coated onto the first surface of the first member as follows: The aqueous solution was coated in stripes onto the surface to a coated amount of 20 g/m2 in terms of solid content. The stripes were deposited across the width with a spacing between the stripes of ½ inch. Then a drying process was performed in a warm air drier set at a temperature of 170 C for 5 minutes. Thereby an area containing the inorganic adhesive was formed with discrete stripes evenly distributed on the entire area of the first surface. In the same manner as above, an area containing the inorganic adhesive was formed with discrete stripes evenly distributed on the entire area of the second surface of the second member.

While both surfaces were coated in Example 6, it is also contemplated that only the first or second surface could be coated. The amount applied to the surfaces could differ from that described in Example 6. The distance between the stripes could also differ, for example anywhere from about ¼ inch to about 2 inches. Additionally, while the stripes of Example 6 are envisioned as straight, it is also contemplated that non-straight stripes are also possible. For example, stripes may zig-zag or be applied as a sine wave, etc.

Example 7

A needle-punched alumina fiber blanket (3M 1600HTE 1474 basis weight available from 3M Company, St. Paul MN) was cut to 84 cm×520 cm.

An adhesive solution was prepared by mixing 950 grams of PQ Type N sodium silicate available from PQ corporation Valley Forge PA, 50 grams of glycerin and 1 gram of acid blue AE03 available from Clariant Corporation Muttenz Switzerland.

The adhesive solution was sprayed on to the first and second surfaces of a first member and a second member using a 3M_16570 Accuspray Model HG18 Spray Gun with a 2 mm fluid tip. Three separate samples were coated with 66, 132, and 273 grams per square meter of wet adhesive. After drying in an oven for 45 minutes at 75° C. the dry coating weights were 32, 64, and 139 grams per square meter respectively.

For each coated sample, mat material test specimens are cut to 44.5×44.5 mm. A piece of 316 stainless steel shim (0.05×50×150 mm) available from Maudlin Products part number 316-002-12-100 was coated on both sides and positioned evenly between two mat material test specimens with the adhesive coating on either side of the stainless steel shim facing one of the mat material test specimens. The assembly consisting of the specimen/shim/specimen is place between two heated 44.5×44.5 mm platens (with horizontal grooves to prevent slippage) at a pressure of 10 psi (68.9 kPa) and held at the noted temperature for 10 minutes. After 10 minutes the shim was removed (pulled vertically) from the assembly at 100 mm/minute while the force was recorded. Evidence of bond formation (presence of adhesive or fiber on the shim, or specimen separation) was noted. See table 3 for results of each temperature set point and adhesive coating weight (gsm). Forces in Table 3 are lbs-force. It is noted that once the bonding point was determined, it was not necessary to test all temperature ranges.

TABLE 3

| Temp- | 32 gsm adhesive | | 64 gsm adhesive | | 139 gsm adhesive | | no adhesive | |
|---|---|---|---|---|---|---|---|---|
| erature | Force | Bond | Force | Bond | Force | Bond | Force | Bond |
| 20 C. | 18.3 | N | | | | | | |
| 50 C. | 19.8 | N | | | | | 16.2 | N |
| 75 C. | 15.46 | N | | | 14 | N | 14.9 | N |
| 100 C. | 14.5 | N | 15.25 | N | 18.5 | Y | 12.4 | N |
| 125 C. | 14.2 | N | 19.3 | Y | 18.7 | Y | 11.1 | N |
| 150 C. | 18.4 | Y | 21.1 | Y | | | 10.5 | N |
| 175 C. | 18.5 | Y | 19.5 | Y | | | 9.9 | N |
| 200 C. | 13 | Y | | | | | 10.9 | N |

Example 8

Bonding Solution Preparation: 95% by weight sodium silicate type N from PQ Corporation and 5% by weight Glycerin were mixed to provide a uniform solution.

Support mat: 1650HTG 1250 GSM from 3M Company

Substrate: Material: Cordierite, Diameter: 3.66" and Length: 3"

Shell: Material: 409 SS

Accelerated Robustness Test Sample Preparation:

1) Bonding solution applied to substrate: Apply liquid bonding solution to the outer surface of the substrate and air dry at room temperature. The weight of the substantially dried bonding solution was 2.5 grams.

2) Bonding solution applied to metallic shell:

Apply liquid bonding solution to the inner surface of the metallic shell and air dry at room temperature. The weight of the substantially dried bonding solution was 4.75 grams 3) Bonding solution applied to substrate and shell:

Apply liquid bonding solution to the outer surface of the substrate and air dry at room temperature. The weight of the substantially dried bonding solution was 2.5 grams. Apply liquid bonding solution to the inner surface of the metallic shell and air dry at room temperature. The weight of the substantially dried bonding solution was 4.75 grams 4) Bonding solution applied to shell side of support mat:

Apply liquid bonding solution to the surface of the support mat that would be in contact with the shell then air dry at room temperature. The weight of the substantially dried bonding solution was 5.0 grams 5) Bonding solution applied to substrate side of support mat:

Apply liquid bonding solution to the surface of the support mat that would be in contact with the substrate then air dry at room temperature. The weight of the substantially dried bonding solution was 5.0 grams 6) Bonding solution applied to both the substrate side and shell side of support mat:

Apply liquid solution to both surfaces of the support mat, then air dry at room temperature. The weight of the substantially dried bonding solution was 5.0 grams per side of the support mat.

7) Control support mat. No bonding agent (i.e., inorganic adhesive)

Sizing: Swage the shell to provide a support mat mount density of 0.25 g/cc. (bonding material not included)

Run a vertical accelerated robustness test on each sample. Record time to failure and vibration intensity level at failure.

Results:

1) Substantially dried bonding agent applied to substrate.
Time to failure: 16:19
Vibration intensity level: 5

2) Substantially dried bonding agent applied to shell.
Time to failure: 20:16
Vibration intensity level: 6

3) Substantially dried bonding agent applied to shell and substrate.
Time to failure: 25:00
Vibration intensity level: 6

4) Substantially dried bonding agent applied to shell side of support mat.
Time to failure: 20:16
Vibration intensity level: 6

5) Substantially dried bonding agent applied to substrate side of support mat.
Time to failure: 21:16
Vibration intensity level: 5

6) Substantially dried bonding agent applied to both sides of support mat.
Time to failure: 25:33
Vibration intensity level: 6

7) Control (no bonding)
Time to failure: 16:25

Vibration intensity level: 5

Note: Vibration intensity level 6 is twice as intense as vibration intensity level 5.

Appling bonding agent (i.e., inorganic adhesive) to the shell side shows better performance than applying it to the substrate side. Applying bonding agent to both surfaces provides the best results. Similar performance improvement is noted when either the substantially dried bonding agent is applied to the support mat or to the substrate and/or shell. Significant robustness over the control is demonstrated especially when a bond if formed between the shell and support mat and especially when a bond is formed on both sides of the support mat.

According to the present disclosure, a mat material applied to an apparatus or a structure used under heating environment is provided, and with the mat material, a shift in position of the mat material and other members in contact therewith during use can be suppressed.

The invention claimed is:

1. A thermal insulation structure comprising:

a first member comprising a first surface capable of being heated to a temperature of 200° C. or higher;

a second member comprising a second surface disposed opposite to the first surface of the first member;

a mat material disposed between the first member and the second member, wherein an adhesive area formed on at least one of the first surface and the second surface comprises an inorganic adhesive, wherein the mat material exhibits a coefficient of friction of 0.75 or higher at 600° C. at the surface in contact with one or both of the first member and second member, wherein the inorganic adhesive exhibits adhesiveness upon being heated, wherein the thermal insulation structure is a pollution control apparatus, with the first member being a pollution control element, the second member being a casing, the pollution control element being provided inside the casing, and the mat material disposed between the casing and the pollution control element;

wherein the inorganic adhesive comprises an alkali metal silicate chosen from sodium silicate, potassium silicate, and lithium silicate.

2. The thermal insulation structure according to claim 1, wherein the inorganic adhesive is substantially dry.

3. The thermal insulation structure according to claim 1, wherein the area containing the inorganic adhesive is formed on both of the first surface and the second surface.

4. The thermal insulation structure according to claim 1, wherein the area containing the inorganic adhesive contains inorganic colloidal particles.

5. The thermal insulation structure according to claim 1, wherein after heating the inorganic adhesive under a temperature condition of 600° C. for 1 hour, a fixed area is formed between the first surface of the first member and the mat material, between the mat material and the second surface of the second member, or both.

6. The thermal insulation structure according to claim 1, wherein after heating the inorganic adhesive under a temperature condition of at least about 100-150° C. for at least about 10 minutes, a fixed area is formed between the first surface of the first member and the mat material, between the mat material and the second surface of the second member, or both.

7. The thermal insulation structure according to claim 1, wherein the content of the alkali metal silicate is from 1 to 400 $g/m^2$ in the adhesive area.

8. The thermal insulation structure according to claim 1, wherein after heating the inorganic adhesive under a temperature condition of 600° C. for 1 hour, a fixed area is formed between an inner surface of the casing and an outer surface of the mat material, between an inner surface of the mat material and an outer surface of the pollution control element, or both.

9. The thermal insulation structure according to claim 1, wherein after heating the inorganic adhesive under a temperature condition of at least about 100-150° C. for at least about 10 minutes, a fixed area is formed between an inner surface of the casing and an outer surface of the mat material, between an inner surface of the mat material and an outer surface of the pollution control element, or both.

10. A method of producing a thermal insulation structure comprising:

providing a first member comprising a first surface capable of being heated to a temperature of 200° C. or higher;

providing a second member comprising a second surface disposed opposite to the first surface of the first member;

coating a solution containing an inorganic adhesive onto at least a part of at least one of the first surface and the second surface; and drying the solution so that the inorganic adhesive is substantially dry on and bonded to at least part of at least one of the first surface and the second surface wherein the thermal insulation structure is a pollution control apparatus, with the first member being a pollution control element, the second member being a casing, the pollution control element being provided inside the casing, and a mat material disposed between the casing and the pollution control element;

wherein the inorganic adhesive comprises an alkali metal silicate chosen from sodium silicate, potassium silicate, and lithium silicate, wherein the mat material exhibits a coefficient of friction of 0.75 or higher at 600° C. at the surface in contact with one or both of the first member and second member.

11. The method according to claim 10, wherein the inorganic adhesive exhibits adhesiveness upon being heated.

12. The method according to claim 10, further comprising heating the inorganic adhesive so as to bond the mat material to at least one of the first surface and the second surface.

* * * * *